US006385519B2

(12) United States Patent
Rocke

(10) Patent No.: US 6,385,519 B2
(45) Date of Patent: May 7, 2002

(54) SYSTEM AND METHOD FOR AUTOMATICALLY CONTROLLING A WORK IMPLEMENT OF AN EARTHMOVING MACHINE BASED ON DISCRETE VALUES OF TORQUE

(75) Inventor: David J. Rocke, Eureka, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/738,465

(22) Filed: Dec. 15, 2000

Related U.S. Application Data

(60) Provisional application No. 60/170,802, filed on Dec. 15, 1999.

(51) Int. Cl.[7] ..... E02F 3/43

(52) U.S. Cl. ..... 701/50; 37/144; 172/415

(58) Field of Search ..... 701/50, 54; 37/444, 37/348; 172/4.5, 10

(56) References Cited

U.S. PATENT DOCUMENTS 5,528,843 A 6/1996 Rocke
5,968,103 A 10/1999 Rocke
5,974,352 A 10/1999 Shull
6,064,933 A 5/2000 Rocke

*Primary Examiner*—Jacques H. Louis-Jacques
*Assistant Examiner*—Arthur D. Donnelly
(74) *Attorney, Agent, or Firm*—Steven G. Kibby

(57) ABSTRACT

A method and system for automatically controlling a work implement of an earthmoving machine, the work implement including a bucket, to capture, lift and dump material, the bucket being controllably actuated by a hydraulic tilt cylinder and at least one hydraulic lift cylinder, based on discrete values of torque is disclosed. The control system includes a torque indicating mechanism that provides a representative value for an amount of torque applied to the wheels of the earthmoving machine, an electronic controller for receiving the representative torque value from the torque indicating mechanism and determining if the representative value of torque received from the torque indicating mechanism exceeds a first predetermined value and then responsively generating a first command signal, and a hydraulic implement controller for controlling hydraulic fluid flow to the hydraulic tilt cylinder in a predetermined sequence activated in response to the first command signal with the hydraulic tilt cylinder controllably actuating the bucket of the earthmoving machine in order to remove material from a pile.

23 Claims, 8 Drawing Sheets

14
10
16
23
26
18
22
24
20
13
12
28

138
PRIMARY RELIEF VALVE
131
OPERATOR INTERFACE
130
MANUAL CONTROL LEVER INPUT
120
128
ELECTRONIC CONTROLLER
MEMORY
146
129
PROGRAMMABLE IMPLEMENT CONTROLLER
127
SIGNAL CONDITIONER
124
FORCE SENSOR
132
TILT CYLINDER CONTROL VALVES
121
LIFT POSITION SENSOR
125
FORCE SENSOR
133
LIFT CYLINDER CONTROL VALVES
122
TILT POSITION SENSOR
134
136
126
FORCE SENSOR
TRANSMISSION RPM SENSOR
ENGINE RPM SENSOR
135

300
310
IDLE MODE
320
CONTACT AND ENGAGE PILE OF MATERIAL WHILE BEGINNING THE CROWDING PROCESS
330
DOES DRIVETRAIN TORQUE EXCEED A FIRST PREDETERMINED VALUE?
IF NEGATIVE
IF POSITIVE
340
UTILIZE A PREDETERMINED TILT SEQUENCE
350
DOES DRIVETRAIN TORQUE FALL BELOW A SECOND PREDETERMINED VALUE?
IF POSITIVE
IF NEGATIVE
F
D
E

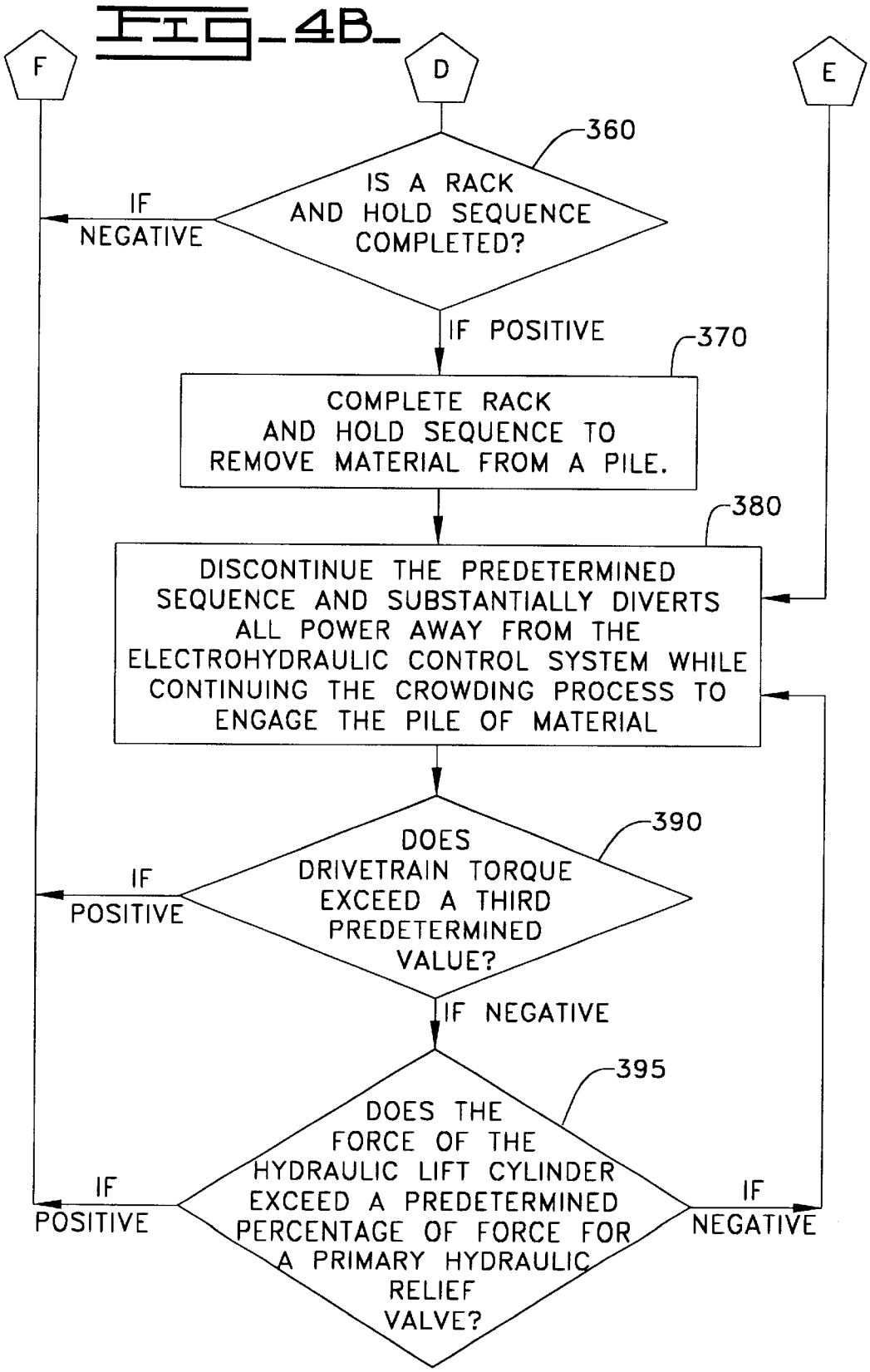
Fig_4B_
F
D
E
360
IS A RACK AND HOLD SEQUENCE COMPLETED?
IF NEGATIVE
IF POSITIVE
370
COMPLETE RACK AND HOLD SEQUENCE TO REMOVE MATERIAL FROM A PILE.
380
DISCONTINUE THE PREDETERMINED SEQUENCE AND SUBSTANTIALLY DIVERTS ALL POWER AWAY FROM THE ELECTROHYDRAULIC CONTROL SYSTEM WHILE CONTINUING THE CROWDING PROCESS TO ENGAGE THE PILE OF MATERIAL
390
DOES DRIVETRAIN TORQUE EXCEED A THIRD PREDETERMINED VALUE?
IF POSITIVE
IF NEGATIVE
395
DOES THE FORCE OF THE HYDRAULIC LIFT CYLINDER EXCEED A PREDETERMINED PERCENTAGE OF FORCE FOR A PRIMARY HYDRAULIC RELIEF VALVE?
IF POSITIVE
IF NEGATIVE

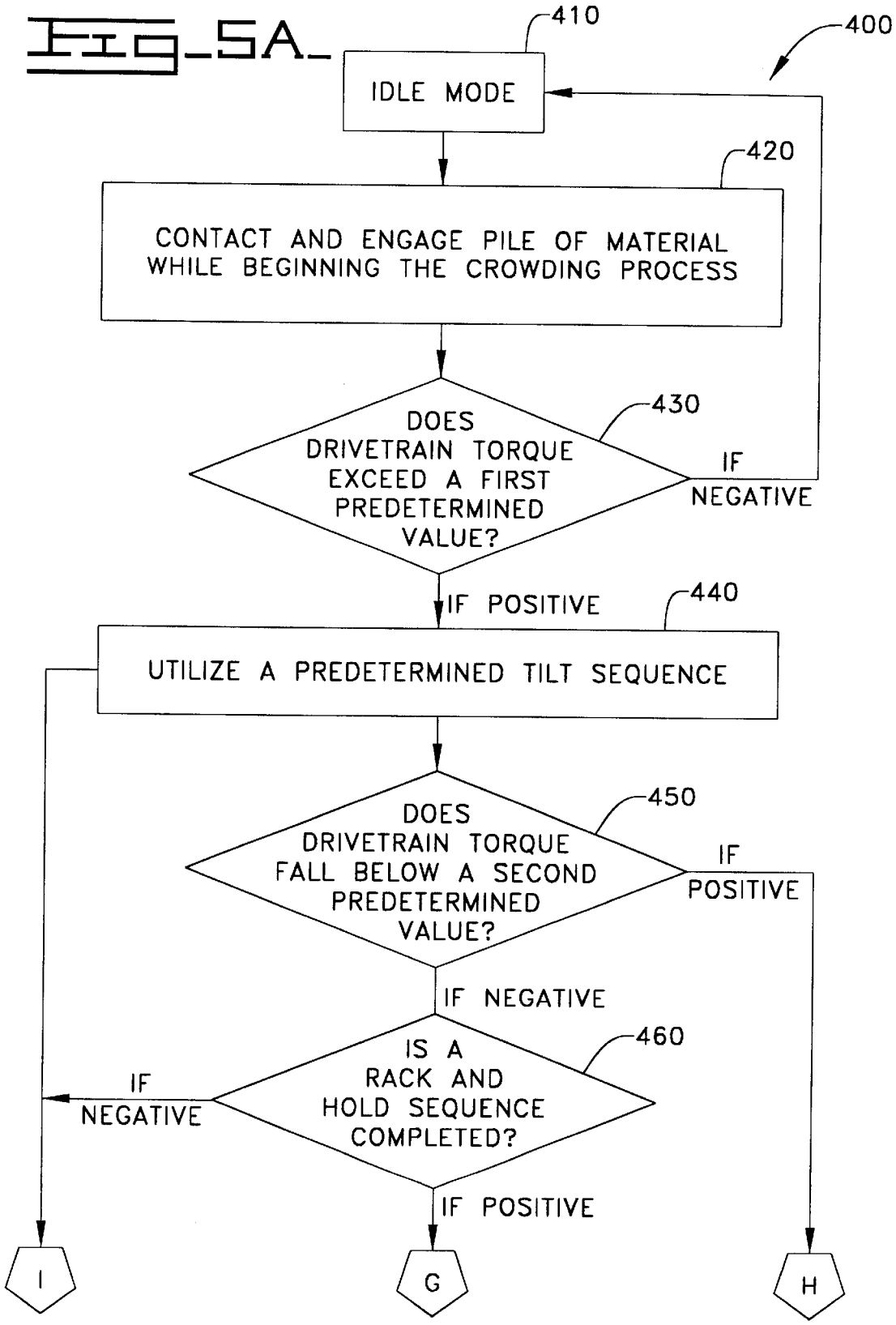
Fig_5A_
400
410
IDLE MODE
420
CONTACT AND ENGAGE PILE OF MATERIAL WHILE BEGINNING THE CROWDING PROCESS
430
DOES DRIVETRAIN TORQUE EXCEED A FIRST PREDETERMINED VALUE?
IF NEGATIVE
IF POSITIVE
440
UTILIZE A PREDETERMINED TILT SEQUENCE
450
DOES DRIVETRAIN TORQUE FALL BELOW A SECOND PREDETERMINED VALUE?
IF POSITIVE
IF NEGATIVE
460
IS A RACK AND HOLD SEQUENCE COMPLETED?
IF NEGATIVE
IF POSITIVE
I
G
H

SYSTEM AND METHOD FOR AUTOMATICALLY CONTROLLING A WORK IMPLEMENT OF AN EARTHMOVING MACHINE BASED ON DISCRETE VALUES OF TORQUE

This application claims the benefit of prior provisional patent application Serial No. 60/170,802 filed Dec. 15, 1999.

TECHNICAL FIELD

This invention relates generally to a control system for automatically controlling a work implement of an earthmoving machine and, more particularly, to a control system that controls the hydraulic cylinders of an earthmoving machine based on discrete values of output torque produced by the drive train of the earthmoving machine so as to ensure engine power is not diverted to the hydraulic system during times when greatest pile penetration capability is needed.

BACKGROUND ART

In general, earthmoving machines such as wheel loaders, excavators, track-type loaders, and the like are used for moving mass quantities of material. These earthmoving machines have work implements that can include a bucket. The bucket is controllably actuated by at least one hydraulic cylinder. The operator typically performs a sequence of distinct operations to capture, lift and dump material.

A typical work cycle for a loader can include an operator first positioning the bucket near the ground surface and close to a pile of material. The operator then directs the machine forward to engage the pile of material, subsequently lifting the bucket to generate a downward force on the machine to maintain traction while racking (tilting) the bucket back to capture the material. The operator then moves the earthmoving machine to a desired target location, e.g., dump truck, and dumps the captured material from the bucket. The operator then moves the earthmoving machine back to the pile of material to start this work cycle all over again.

U.S. Pat. No. 5,968,103 issued Oct. 19, 1999 to the present inventor, discloses a system and method for automatic bucket loading which controls the bucket tilt command in proportion to a sensed crowd factor. Crowd factors are sensed machine parameters, such as bucket force and driveline torque, which provide an indication of the degree to which the bucket of the machine is "crowding" the material. The efficiency with which the bucket captures material depends upon how effectively the machine penetrates the pile of material to fill the bucket before breaking free, while avoiding going so deep as to stall the machine or overload the ability of the hydraulic systems to break the bucket loose.

In the automated loading system disclosed in the Rocke '103 patent, the control strategy typically proceeds immediately from lifting the bucket to racking, thereby diverting power to the hydraulic system during a time when more torque may be needed to penetrate the pile. When loading difficult materials, this diversion of power from the drive train can prevent the machine from fully engaging the pile, and result in only partially full bucket loads.

The present invention is directed to overcoming one or more of the problems set forth above.

DISCLOSURE OF THE INVENTION

In one aspect of this invention, a control system for automatically controlling a work implement of an earthmoving machine the work implement including a bucket, to capture, lift and dump material, the bucket being controllably actuated by a hydraulic tilt cylinder and at least one hydraulic lift cylinder is disclosed. The control system includes a torque indicating mechanism that provides a representative value for an amount of torque produced by the drive train of the earthmoving machine, an electronic controller for receiving the representative torque value from the torque indicating mechanism, generating a lift command signal responsive to sensed contact with the material to establish traction, terminating the lift command signal, determining when the representative value of torque received from the torque indicating mechanism exceeds a first predetermined value and then responsively generating a tilt command signal, and a hydraulic implement controller for controlling hydraulic fluid flow to the hydraulic cylinders in response to the command signals, wherein the predetermined value is selected so as to provide a delay between termination of the lift command signal and generation of the tilt command signal.

In another aspect of the present invention, a method for controlling a work implement of an earthmoving machine, the work implement including a bucket, to capture, lift and dump material, the bucket being controllably actuated by a hydraulic tilt cylinder and at least one hydraulic lift cylinder. The method includes the steps of providing a representative value of torque produced by the drive train of the earthmoving machine with a torque indicating mechanism, receiving the representative torque signal from the torque indicating mechanism, generating a lift command signal responsive to sensed contact with the material to establish traction, terminating the lift command signal, determining when the representative value of torque received from the torque indicating mechanism exceeds a first predetermined value and then responsively generating a tilt command signal with an electronic controller, and controlling hydraulic fluid flow to the hydraulic cylinders in response to the command signals.

BRIEF DESCRIPTION OF THE DRAWINGS

For a better understanding of the present invention, reference may be made to the accompanying drawings in which:

FIGS. 4A and 4B are a flowchart illustrating a first alternative embodiment of the software for automatically controlling a bucket of an earthmoving machine to capture, lift and dump material based on discrete values of output torque supplied to the wheels of an earthmoving machine according to FIGS. 3A and 3B that also determines if the force of the hydraulic cylinders exceeds a predetermined percentage of a primary hydraulic relief valve prior to entering into a predetermined sequence and then controllably actuating the bucket of the earthmoving machine in order to remove material from a pile; and FIGS. 5A and 5B are a flowchart illustrating a second alternative embodiment of the software for automatically controlling a bucket of an earthmoving machine to capture, lift and dump material based on discrete values of output torque supplied to the wheels of an earthmoving machine according to FIGS. 3A and 3B that also determines if the force of the hydraulic lift cylinder(s) drops below a predetermined limit value or a predetermined threshold value prior to entering into a predetermined sequence and then controllably actuating the bucket of the earthmoving machine in order to remove material from a pile.

BEST MODE FOR CARRYING OUT THE INVENTION

Figure 1:
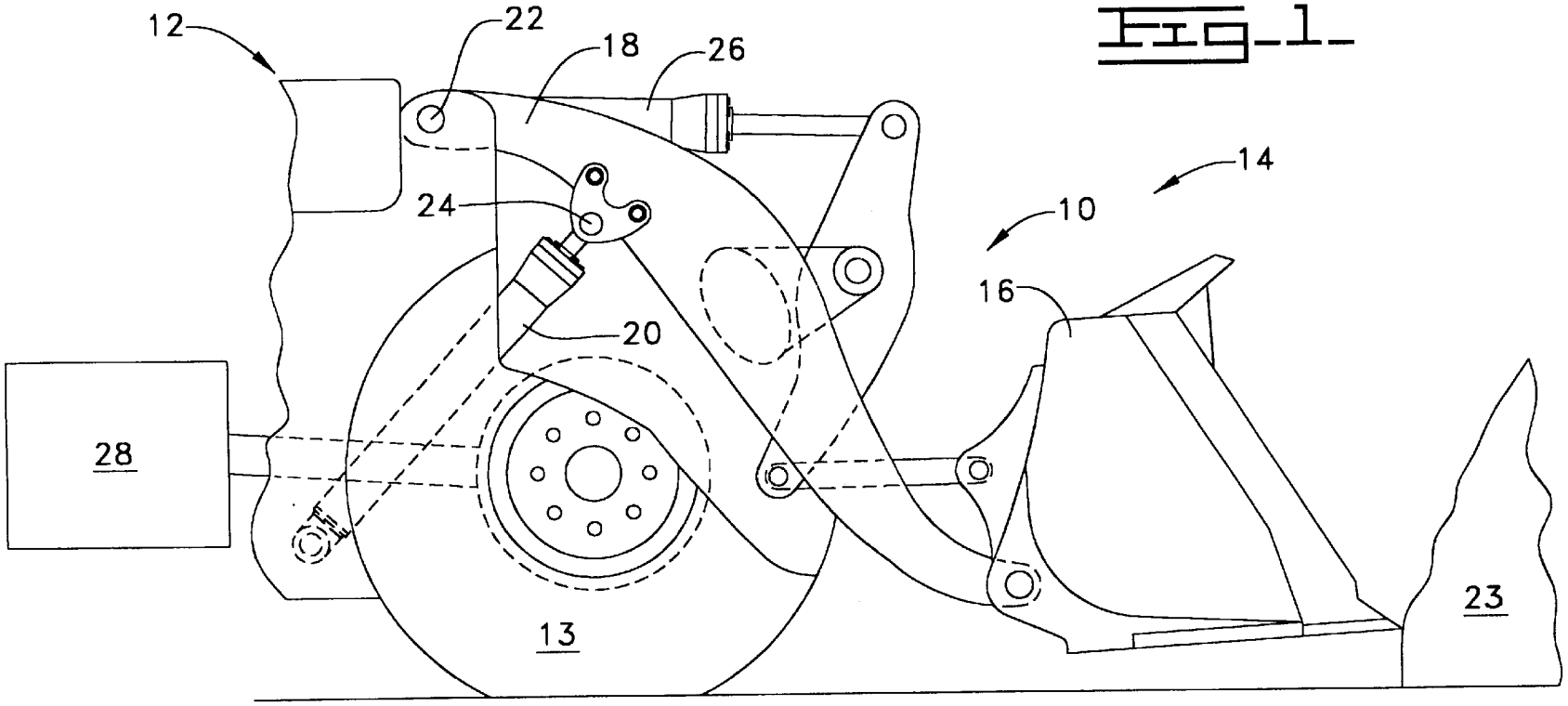
FIG. 1 is a diagrammatic view of a work implement of an earthmoving machine.

Referring now to the drawings, and initially to FIG. 1, an automatic bucket loading system for an earthmoving machine is generally indicated by numeral 10. FIG. 1 only illustrates a forward portion of loader having a work implement 14 and wheels 13, while the present invention is applicable to a wide variety of machines such as track-type loaders and other machines having similar material loading implements. The work implement 14 may include a bucket 16 that is connected to a lift arm assembly 18. However, any of a wide variety of devices for capturing, lifting and dumping a pile of material 23 may function as the bucket 16. The lift arm assembly 18 is pivotally actuated by a pair of hydraulic lift cylinder(s) 20 (only one of which is shown) about a pair of lift arm pivot pins 22 (only one of which is shown) that are attached to the frame of the earthmoving machine 12. A pair of lift arm load bearing pivot pins 24 (only one of which is shown) is attached to the lift arm assembly 18 and the hydraulic lift cylinder(s) 20. The bucket 16 is also tilted or "racked" by a hydraulic tilt cylinder 26.

Figure 2:
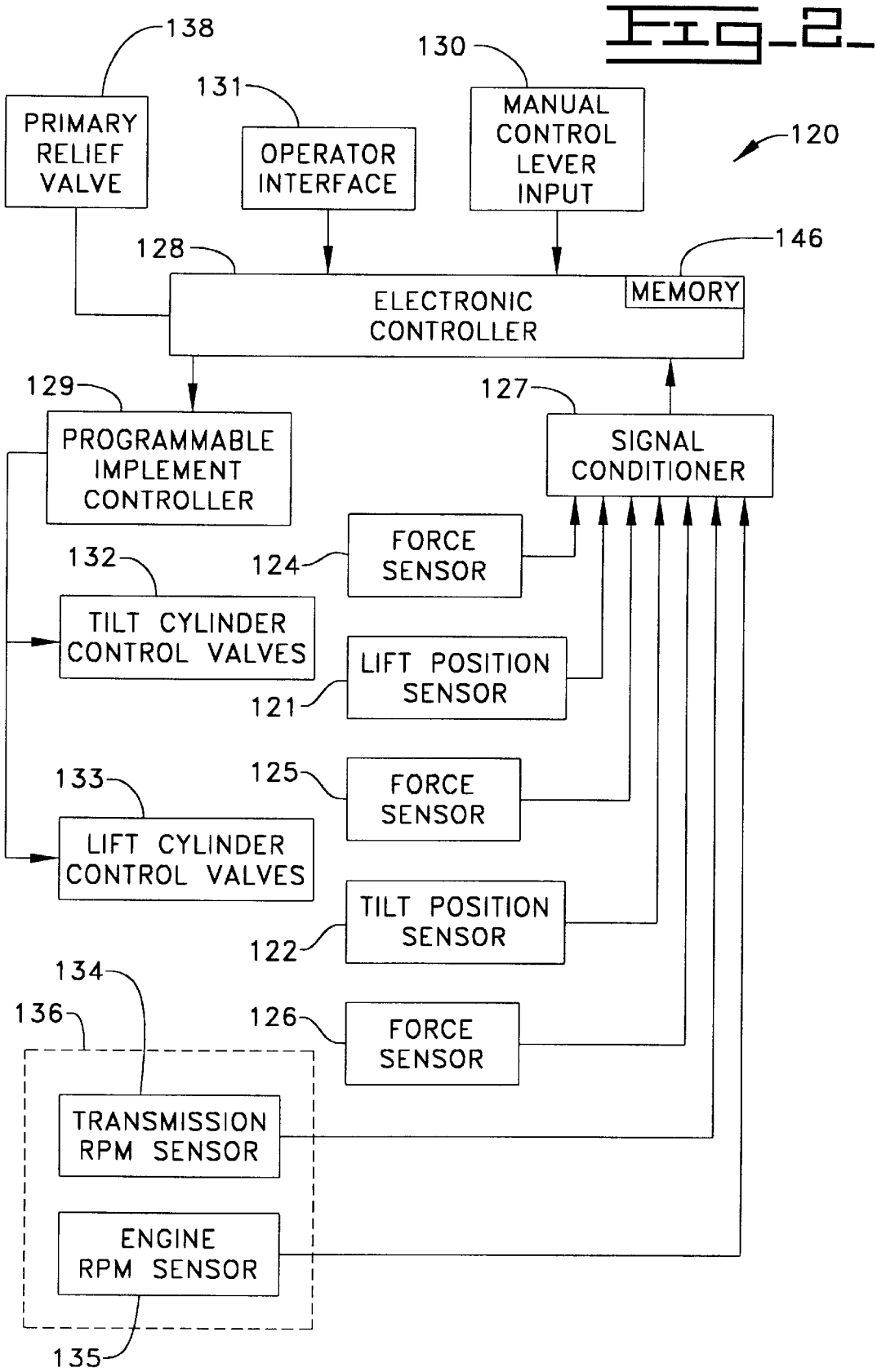
FIG. 2 is a hardware block diagram of various aspects of a control system for an earthmoving machine relating to the present invention.

Referring now to FIG. 2, which is a block diagram of an electrohydraulic control system generally indicated by numeral 120 according to one embodiment of the present invention in conjunction with the components previously referenced in FIG. 1. Although this invention does not require it and a predetermined lift and tilt pattern is preferably utilized, the optimal embodiment will probably include position sensors 121 and 122 and force sensors 124, 125 and 126.

Lift and tilt position sensors 121 and 122, respectively, produce position signals in response to the position of the bucket 16 relative to the earthmoving machine 12 by sensing the piston rod extension of the hydraulic lift and tilt cylinders 20 and 26, respectively. Radio frequency resonance sensors such as those disclosed in U.S. Pat. No. 4,737,705 to Bitar et al. may be used for this purpose, or alternatively the position can be directly derived from work implement joint angle measurements using rotary potentiometers, yo-yos or the like to measure rotation at lift arm pivot pins 22 and lift arm load bearing pivot pins 24.

Force sensors 124, 125 and 126 produce signals representative of the hydraulic forces exerted on the bucket 16, preferably by sensing the pressures in the hydraulic lift cylinder(s) 20 and alternatively in the hydraulic tilt cylinder 26. The hydraulic lift cylinder(s) 20 are not retracted during loading, therefore a sensor is provided only at the head end of the hydraulic lift cylinder 20, which is typically oriented to provide upward movement. Sensors may be provided at both head and rod ends of the hydraulic tilt cylinder 26, however, in order to permit force determinations during both racking and unracking of the bucket 16 when appropriate to a particular control strategy. The pressure signals may be converted to corresponding force values through multiplication by a gain factor representative of the respective cross-sectional areas A of the piston ends of the hydraulic tilt cylinder 26. The representative force $F_T$ of the hydraulic tilt cylinder 26 corresponds to the difference between the product of the head end pressure and area and the product of the rod end pressure and area:

$$F_T = P_H * A_H - P_R * A_R$$

In an alternative embodiment, load cells or similar devices located at joints on the work implement may be utilized as force sensors 124, 125 and 126.

This is only one aspect of the electrohydraulic control system 120, which may include both position and displacement sensors and a variety of associated control algorithms.

Torque converter output torque T supplied to wheels 13 is a function of the torque converter input and output speeds, typically being sensed at the engine and drivetrain 28 on either the transmission, axle or torque converter output shaft. Throughout this patent application, output torque T does not have to be physically measured and can be derived or calculated from other measurements at numerous points between the engine (not shown) and the wheels 13. Transmission, gear and engine speed can readily be monitored from a transmission controller 136 using passive pickups, such as a transmission r.p.m. sensor 134 and an engine r.p.m. sensor 135 producing electrical signals representative of rotational frequency, such as from passing gear teeth. A torque converter performance table unique to a specific torque converter design tabulates converter output torque for given torque converter input and output speeds.

Machine ground speed S is similarly determined as a function of sensed transmission, torque converter output shaft or axle speed, with appropriate compensation for transmission or other gear reductions inherent in the drivetrain 28.

The position, force and speed signals may be delivered to a signal conditioner 127 for conventional signal excitation and filtering. The conditioned signals are then delivered to an electronic controller 128. The electronic controller 128 can be a microprocessor-based system that utilizes arithmetic units to control processes according to software programs. The electronic controller 128 can include, but is not limited to, a processor such as a microprocessor; however, any of a wide variety of computing devices will suffice. The electronic controller 128 preferably includes, but is not limited to, a memory device 146 and a clock (not shown), and is representative of both floating point processors, and fixed point processors. The electronic controller 128 is operable for receiving information from a variety of sensors and other devices associated with the automatic bucket loading system 10. Typically, the programs are stored in the memory device 146, which may be but is not limited to, a read-only memory, random-access memory or the like that are typically a component of the electronic controller 128.

In addition, the electronic controller 128 utilizes arithmetic units to generate signals mimicking those produced by manual control lever inputs 130, e.g., joystick, according to software programs stored in the memory device 146. By mimicking command signals representative of desired lift/tilt cylinder movement direction and velocity conventionally provided by manual control lever inputs 130, the present invention can be advantageously retrofit to existing machines by connection to a programmable implement controller 129 in parallel with, or intercepting, the manual control lever inputs 130. Alternatively, an integrated electrohydraulic controller may be provided by combining electronic controller 128 and a programmable implement controller 129 in to a single unit in order to reduce the number of components. A machine operator may optionally enter control specifications, such as material condition settings discussed hereinafter, through an operator interface 131 such as an alphanumeric key pad, dials, switches, or a touch sensitive display screen.

The programmable implement controller 129 includes hydraulic circuits having tilt and lift cylinder control valves 132 and 133, respectively, for controlling the rate at which pressurized hydraulic fluid flows to respective hydraulic lift and tilt cylinders 20 and 26, respectively, in proportion to received velocity command signals, in a manner well known to those skilled in the art. Lift and tilt hydraulic cylinder velocity command signals are for brevity referred to hereinafter as lift or tilt commands or command signals. The output of the manual control lever inputs 130 determine the movement, direction and velocity of the work implement 14.

In operation, the electronic controller 128 controls movement of the bucket 16 using command signals. A work machine, such as a loader 12, is driven toward the pile of material 23 to be loaded with the bottom of the bucket 16 nearly level and close to the ground. After a tip of the bucket 16 contacts and begins digging into the pile of material 23, command signals are generated to lift and rack the bucket 16 through the pile of material 23 while the loader 12 continues to be driven forward on wheels 13, referred to herein as "crowding" the pile of material 23. The drivetrain torque T of the wheel-type earthmoving machine 12 is monitored and this parameter increases as a result of the resistance encountered by the bucket 16. If this is the initial penetration of the bucket 16 and a predetermined lift cylinder force is exceeded, then substantially all of the power in the loader 12 is diverted to the drivetrain 28 with minimal power applied to hydraulics controlling the work implement 14, with very little power, if any, applied to the lift cylinder control valves 133. This will only occur after this predetermined lift cylinder force is exceeded, which indicates the wheels 13 of the loader 12 have good traction to allow this substantial diversion of power to the drivetrain 28. This provides maximum penetration and full engagement of the bucket 16 into the pile of material 23. The drivetrain torque T of the loader 12 continues to build up until the drivetrain torque T reaches a first predetermined value or set point A. If this first predetermined value or set point A is significantly exceeded, torque converter stall can occur.

At this point of full penetration, the loader 12 enters a predetermined tilt command sequence with the electronic controller 128 providing command signals through the programmable implement controller 129 to the tilt cylinder control valve 132 that actuates the hydraulic tilt cylinder 26. This predetermined tilt command sequence is generated to move the tip of the bucket 16 closer to the surface of the material in the pile 23, eventually relieving the drivetrain torque T by reducing the resistance from the pile of material 23, so that the loader 12 can move forward as the material in the bucket 16 moves towards the back of the bucket 16.

Racking of the bucket 16 too quickly or too much can bring the bucket 16 toward the,surface of the pile of material 23 before the bucket 16 was full and could reduce the force in the hydraulic lift cylinder(s) 20, leading to slippage of the wheels 13. Therefore, the predetermined tilt command sequence is turned off when the drivetrain torque T falls below a second predetermined value or set point B.

Another option might be to maintain the predetermined tilt command sequence, even if the drivetrain torque T falls below the second predetermined value or set point B so long as the force of the hydraulic lift cylinder(s) 20 exceeds a predetermined percentage of a primary hydraulic relief valve 138 for the electrohydraulic control system 120 for the loader 12. This percentage varies depending on the type, manufacturer, size, and so forth for the earthmoving machine. A nonlimiting example of this percentage would be 110%.

The spread or difference between the first predetermined value or set point A and the second predetermined value or set point B for drivetrain 28 torque T should not be too great, which leads to long periods of tilting for the bucket 16 or too small a difference which leads a potential frequency of on-off cycling of the predetermined tilt command that is less than ideal. The range of spread can be between zero (0) to about fifty (50) percent and preferably between four (4) to about fifteen (15). This range of spread or difference can vary tremendously depending on the particular machine, material and operator preferences.

It is important to note that the predetermined tilt command must remain on or off for a minimum period to prevent chatter. This time period is dependant on the type, manufacturer, and size of the earth moving machine and associated hydraulic system.

When the loader 12 is in the predetermined tilt sequence, in the preferred embodiment, hydraulic flow may only be available to the hydraulic lift cylinder(s) 20 if the flow to the hydraulic tilt cylinder 26 is less than a certain percentage. Once again, this percentage is dependant on the type, manufacturer, and size of earth moving machine and associated hydraulic system and is a function of machine design.

Alternatively, force value forecasting may be utilized to calculate the rate of change $dN=f(n-3)-f(n)$ of force in the hydraulic lift cylinder(s) 20 in order to predict when the lift force will drop below a predetermined limit that is needed in order to overcome hydraulic lag. The rate of change of force in the hydraulic lift cylinder(s) 20 can also be compared to a predetermined threshold to determine how quickly lift force could reach a level that would lead to slippage of the wheels 13.

The software for automatically controlling a bucket 16 of a loader 12 to capture and lift material from a source location, e.g., pile of material 23, based on discrete values of output drivetrain 28 torque T will now be discussed with reference to FIGS. 3A and 3B, which depict a flowchart, indicated in general by reference numeral 200, representative of the computer program instructions executed by the electronic controller 128 shown in FIG. 2. In the description of the flowcharts, the functional explanation marked with numerals in angle brackets, <nnn>, will refer to the flowchart blocks bearing that number.

Figure 3A:
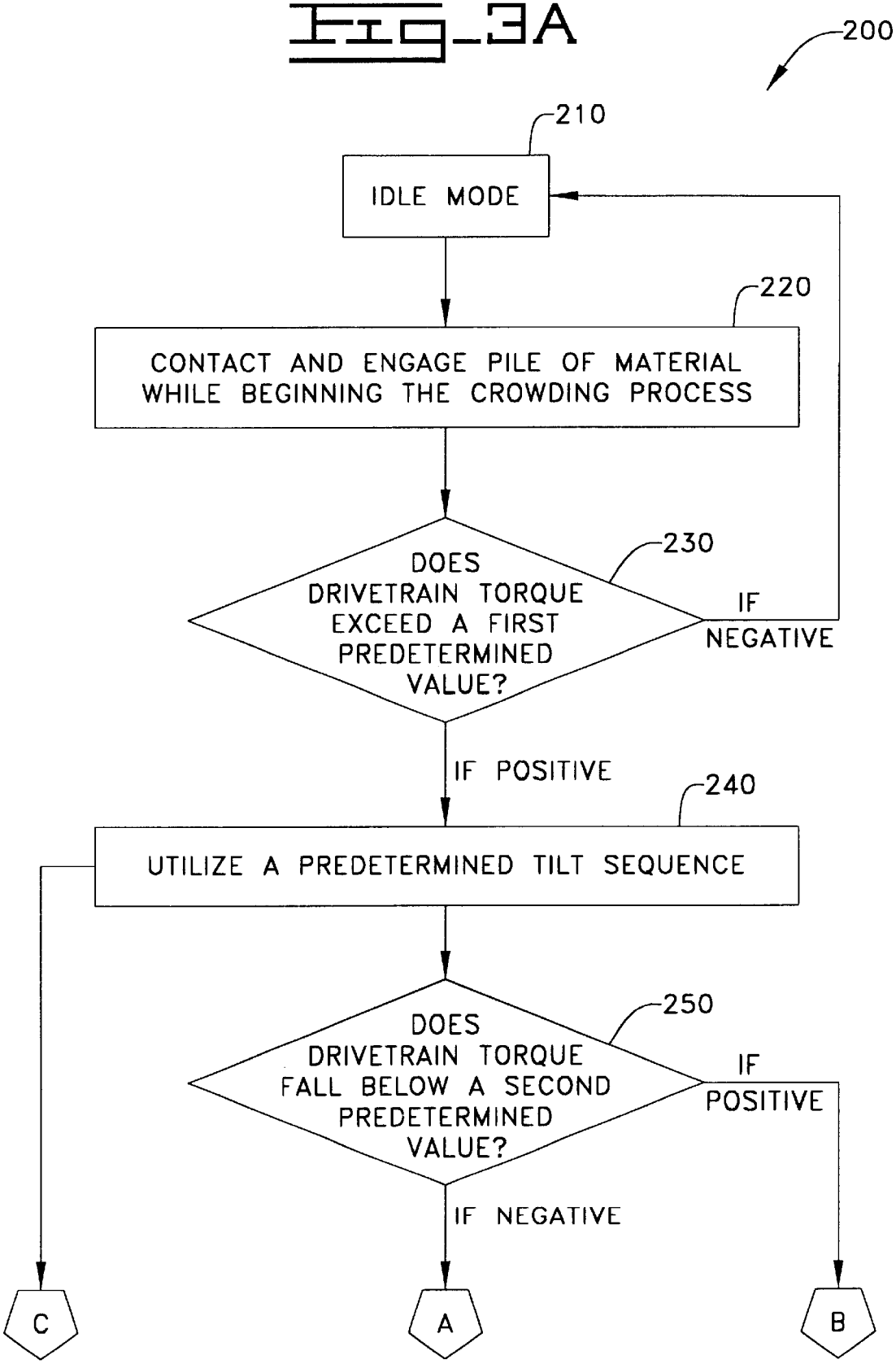
FIGS. 3A and 3B are a flowchart illustrating software for automatically controlling a bucket of an earthmoving machine to capture, lift and dump material based on discrete values of output torque supplied to the wheels of an earthmoving machine.
Figure 3B:
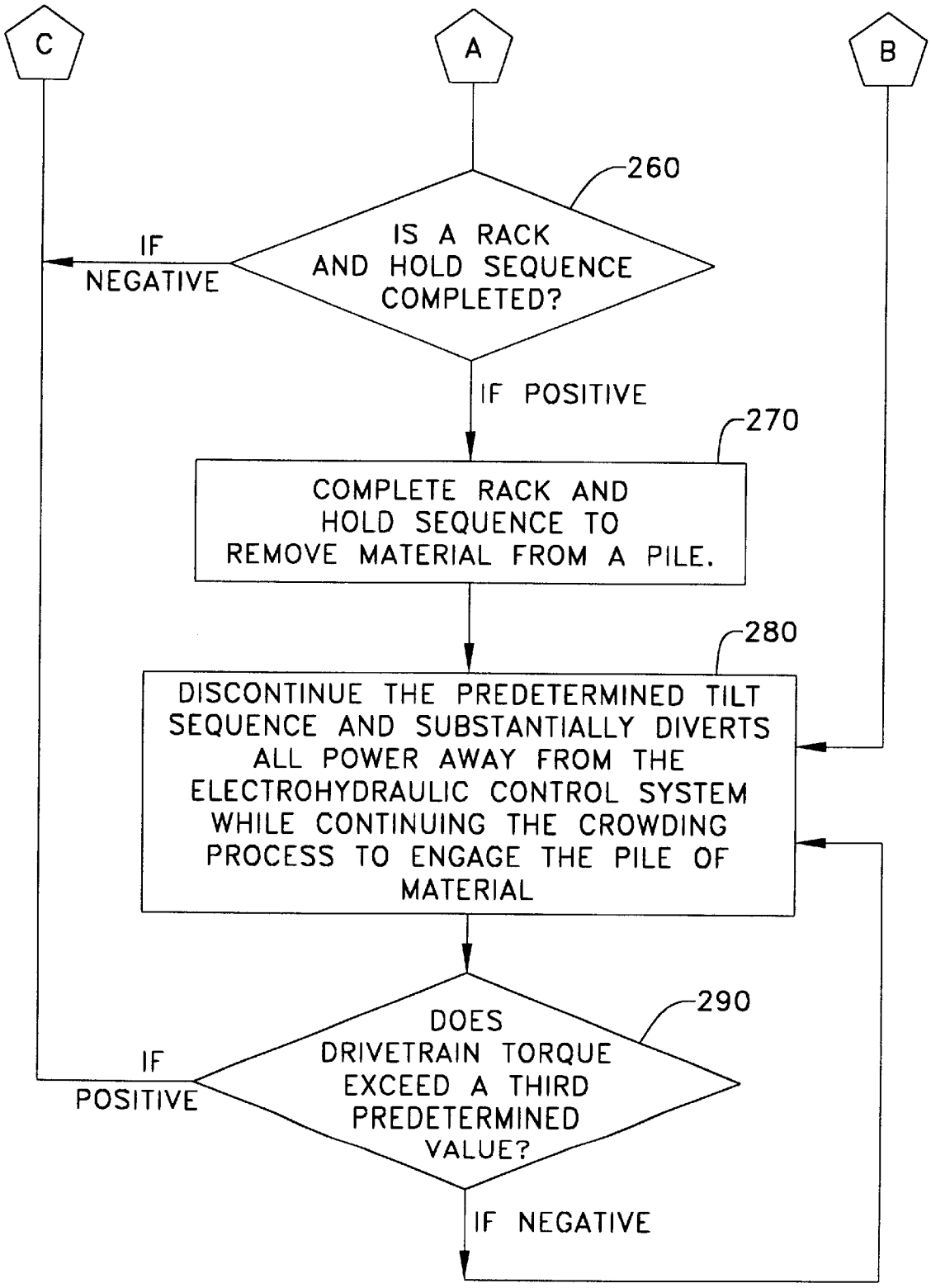

As shown in FIGS. 3A and 3B, and initially to FIG. 3A, the program control initially begins at program step <210> when a MODE variable is set to IDLE. MODE will be set to IDLE in response to the operator actuating a switch for enabling automated loading control for the bucket 16. Although the program control is in an IDLE MODE, command signals will not be automatically generated if the operator has not substantially leveled the bucket 16 near the surface of the ground. A bucket 16 position derived from hydraulic lift and tilt cylinders 20 and 26, respectively, or position signals from lift arm pivot pins 22 and lift arm load bearing pivot pins 24, may be used to determine whether a floor of the bucket 16 is substantially level and near ground. Additional sensed values, which may be monitored to ensure that automatic loading of the bucket 16 is not engaged accidentally or under conditions not within normal operating parameters, include:

The speed of the loader 12 within a specified range, such as between one third top first gear speed and top second gear speed;

Manual control lever inputs 130 are in substantially a centered, neutral position, (a slight downward command may be allowed to permit floor cleaning); and Transmission shift lever (not shown) is in a low forward gear, e.g. first through third, and at least a predetermined time has elapsed since the last upshift.

The operator then directs the loader 12 into the pile of material 23, preferably at close to maximum power setting within selected gear range by the time the pile of material 23 is fully engaged.

A second program step <220> is to contact and engage the pile of material 23 with the bucket 16 while beginning the crowding process with the loader 12. If this is the initial penetration of the bucket 16 and a predetermined lift cylinder force is exceeded, then substantially all of the power in the loader 12 is diverted to the drivetrain 28 with minimal power applied to hydraulics controlling the work implement 14, with very little power, if any, applied to the lift cylinder control valves 133. This will only occur after this predetermined lift cylinder force is exceeded, which indicates the wheels 13 of the loader 12 have good traction to allow this substantial diversion of power to the drivetrain 28.

A third program step <230> is a determination if the drivetrain 28 torque T of the loader 12-exceeds a first predetermined value. If the response to this query is negative, programs steps <220> and <230> are continually repeated. If the response to this query is positive, the software program proceeds to a fourth program step <240>.

A fourth program step <240> utilizes a predetermined tilt sequence involving the bucket 16 of the loader 12. This allows the bucket 16 to cut upward while letting material slide to the back portion of the bucket 16. This predetermined tilt sequence also avoids stalling of the drivetrain 28.

A fifth program step <250> is a determination if the drivetrain torque T of the loader 12 falls below a second predetermined value. If the response to this query is negative, then the software program proceeds to a sixth program step <260> as shown in FIG. 3B, which determines if a rack and hold sequence with the loader 12 has occurred. If the answer to this query is negative, then program steps <240>, <250>, and <260> are repeated. If the answer to the query in program step <260> is positive, then the rack and hold sequence is completed with material removed from the pile of material 23, as a seventh program step <270>. Lift may be included in this sequence, however, lift is typically not an aspect of this sequence.

If the response to the query in the fifth program step <250> involving the determination of whether the drivetrain torque T of the loader 12 falls below a second predetermined value is positive, then the software program proceeds to the eighth program step <280>, which discontinues the predetermined tilt sequence and substantially diverts all power to the drivetrain 28 of the loader 12 while continuing the crowding process to engage the pile of material 23.

A ninth program step determines if the drivetrain torque T of the loader 12 exceeds a third predetermined value <290>. This third predetermined value is typically similar, if not identical, to the first predetermined value, however depending the configuration of the loader 12, this third predetermined value may be different than the first predetermined value. If the response to this query is negative, then program steps <280> and <290> are continuously repeated. If the response to this query is positive, then the software program goes to program step <240> to again utilize the predetermined tilt sequence, and hopefully, unless diverted again into program step <280> will complete the rack and hold sequence with program steps <250> through <270>.

The software for a first alternative embodiment for automatically controlling a bucket 16 of a loader 12 to capture and lift material from a source location, e.g., pile of material 23, based on discrete values of output drivetrain torque T utilizing an option that determines if the force of the hydraulic lift cylinder(s) 20 exceeds a predetermined percentage of a primary hydraulic relief valve 138 will now be discussed with reference to FIGS. 4A and 4B, and initially to FIG. 4A, which depicts a flowchart, indicated in general by reference numeral 300, representative of the computer program instructions executed by the electronic controller 128 shown in FIG. 2. In the description of the flowcharts, the functional explanation marked with numerals in angle brackets, <nnn>, will refer to the flowchart blocks bearing that number.

Figure 4A:
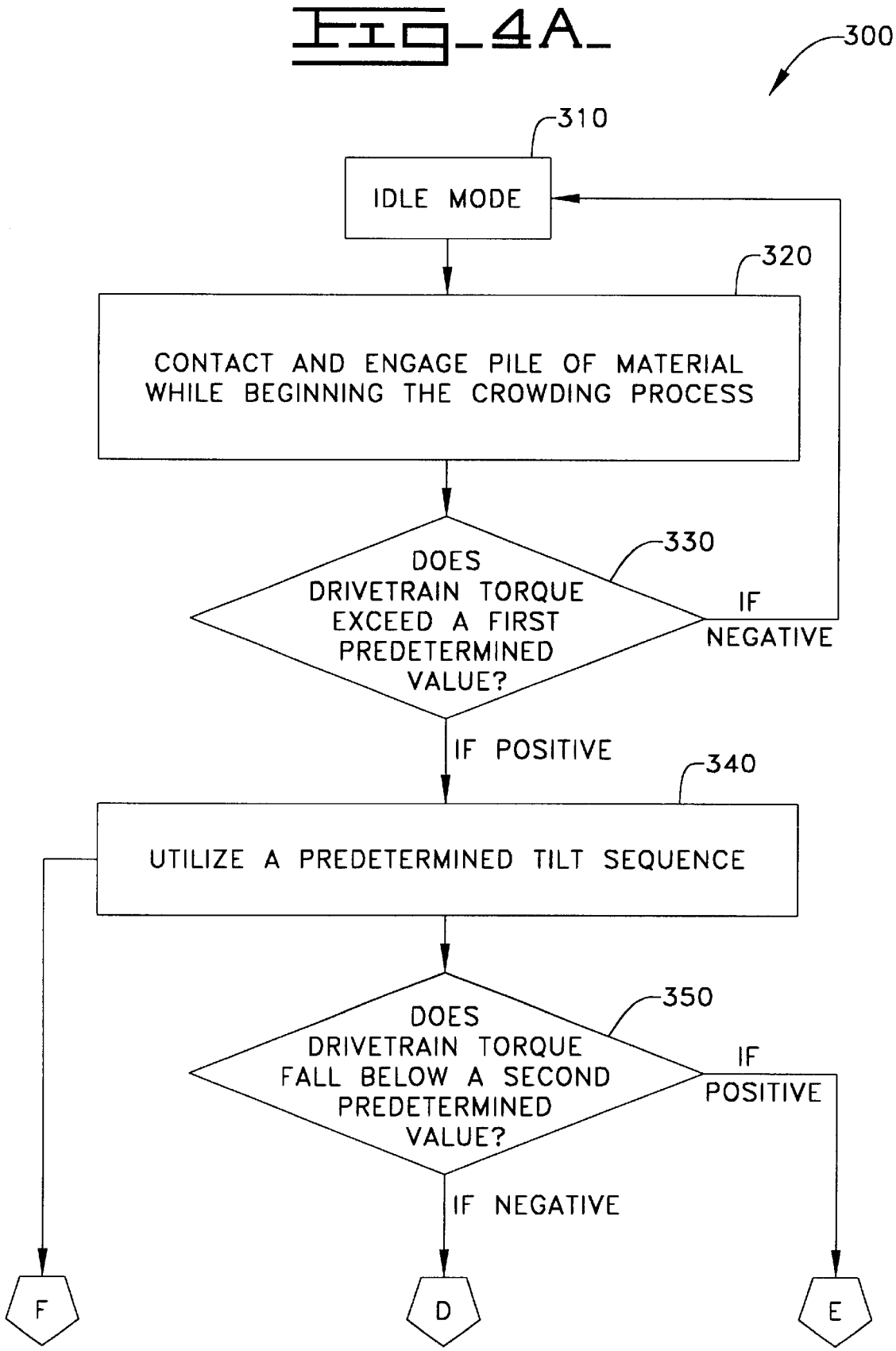

As shown in FIG. 4A, as with the above software program, the program control initially begins at program step <310> when a MODE variable is set to IDLE. The operator then directs the loader 12 into the pile of material 23, preferably at close to maximum power setting within selected gear range by the time the pile of material 23 is fully engaged.

A second program step <320> is to contact and engage the pile of material 23 with the bucket 16 while beginning the crowding process with the loader 12. If this is the initial penetration of the bucket 16 and a predetermined lift cylinder force is exceeded, then substantially all of the power in the loader 12 is diverted to the drivetrain 28 with minimal power applied to hydraulics controlling the work implement 14, with very little power, if any, applied to the lift cylinder control valves 133. This will only occur after this predetermined lift cylinder force is exceeded, which indicates the wheels 13 of the loader 12 have good traction to allow this substantial diversion of power to the drivetrain 28.

A third program step <330> is a determination if the drivetrain torque T of the loader 12 exceeds a first predetermined value. If the response to this query is negative, programs steps <320> and <330> are continually repeated. If the response to this query is positive, the software program proceeds to the fourth program step <340>.

A fourth program step <340> utilizes a predetermined tilt sequence involving the bucket 16 of the loader 12. This allows the bucket 16 to cut upward while letting material slide to the back portion of the bucket 16. This predetermined tilt sequence also avoids stalling of the drivetrain 28.

A fifth program step <350> is a determination if the drivetrain torque T of the loader 12 falls below a second predetermined value. If the response to this query is negative, then the software program proceeds to a sixth program step <360> as shown in FIG. 4B, which determines if a rack and hold sequence with the loader 12 has occurred. If the answer to this query is negative, then program steps <340>, <350>, and <360> are repeated. If the answer to the query in programs step <360> is positive, then the rack and hold sequence is completed as the seventh program step <370>. Lift may be included in this sequence, however, lift is typically not an aspect of this sequence.

If the response to the query in the fifth program step <350> involving the determination of whether the drivetrain torque T of the loader 12 falls below a second predetermined value is positive, then the software program proceeds to the eighth program step <380>, which discontinues the predetermined tilt sequence and substantially diverts all power from the electrohydraulic control system 120 of the loader 12 to the drivetrain 28 of the loader 12 while continuing the crowding process to engage the pile of material 23.

A ninth program step determines if the drivetrain torque T of the loader exceeds a third predetermined value <390>.

This third predetermined value is typically similar, if not identical, to the first predetermined value, however depending the configuration of the loader 12, this third predetermined value may be different than the first predetermined value. If the response to this query is positive, then the software program goes to program step <340> to again utilize the predetermined tilt sequence, and hopefully, unless diverted again into program step <380> will complete the rack and hold sequence with program steps <350> through <370>.

If the response to this query is negative, then the software program proceeds to the tenth program step <395>, which then determines if the force of the hydraulic lift cylinder(s) 20 exceeds a predetermined percentage of force for a primary hydraulic relief valve 138. This predetermined percentage of force for the primary hydraulic relief valve is dependant on the type, manufacturer, and size of earth moving machine and associated hydraulic system. This percentage can range from about one hundred percent (100%) to about one hundred and fifty percent (150%). This is very dependent on machine configuration and with one type of machine is optimally operating between one hundred and five percent (105%) to about one hundred and fifteen percent (115%) while another type of machine is optimally operating between one hundred and twenty-five percent (125%) to about one hundred and forty-five percent (145%).

If the response to this query is positive, then the software program returns to program step <340> to again utilize the predetermined tilt sequence, and hopefully, unless diverted again into program step <380> will complete the rack and hold sequence with program steps <350> through <370>.

If the response to this query in program step <395> is negative, then the software program goes back to program step <380> to again discontinue the predetermined tilt sequence and substantially divert all power from the electrohydraulic control system 120 of the loader 12 to the drivetrain 28 of the loader 12 to continue the crowding process on the pile of material 23 as well as program step <390> which determines if the drivetrain torque T of the loader 12 exceeds a second predetermined value.

The software for a second alternative embodiment for automatically controlling a bucket 16 of a loader 12 to capture and lift material from a source location, e.g., pile of material 23, based on discrete values of output drivetrain torque T utilizing an option that determines if the rate of change in the force to the hydraulic lift cylinder(s) 20 drops below a predetermined limit value or the rate of change in the force to the hydraulic lift cylinder(s) 20 when compared to a threshold value. In both instances, this would indicate a condition that could lead to slippage of the wheels 13. This second alternative embodiment will now be discussed with reference to FIGS. 5A and 5B, which depicts a flowchart, indicated in general by reference numeral 400, representative of the computer program instructions executed by the electronic controller 128 shown in FIG. 2.

As shown in FIG. 5A, as with the above software program, the software program initially begins at program step <410> when a MODE variable is set to IDLE. The operator then directs the loader 12 into the pile of material 23, preferably at close to maximum power setting within selected gear range by the time the pile of material 23 is fully engaged.

A second program step <420> is to contact and engage the pile of material 23 with the bucket 16 while beginning the crowding process with the loader 12. If this is the initial penetration of the bucket 16 and a predetermined lift cylinder force is exceeded, then substantially all of the power in the loader 12 is diverted to the drivetrain 28 with minimal power applied to hydraulics controlling the work implement 14, with very little power, if any, applied to the lift cylinder control valves 133. This will only occur after this predetermined lift cylinder force is exceeded, which indicates the wheels 13 of the loader 12 have good traction to allow this substantial diversion of power to the drivetrain 28.

A third program step <430> is a determination if the drivetrain torque T of the loader 12 exceeds a first predetermined value. If the response to this query is negative, programs steps <420> and <430> are continually repeated. If the response to this query is positive, the software program proceeds to a fourth program step <440>.

A fourth program step <440> utilizes a predetermined tilt sequence involving the bucket 16 of the loader 12. This allows the bucket 16 to cut upward while letting material slide to the back portion of the bucket 16. This predetermined tilt sequence also avoids stalling of the drivetrain 28.

Figure 5B:
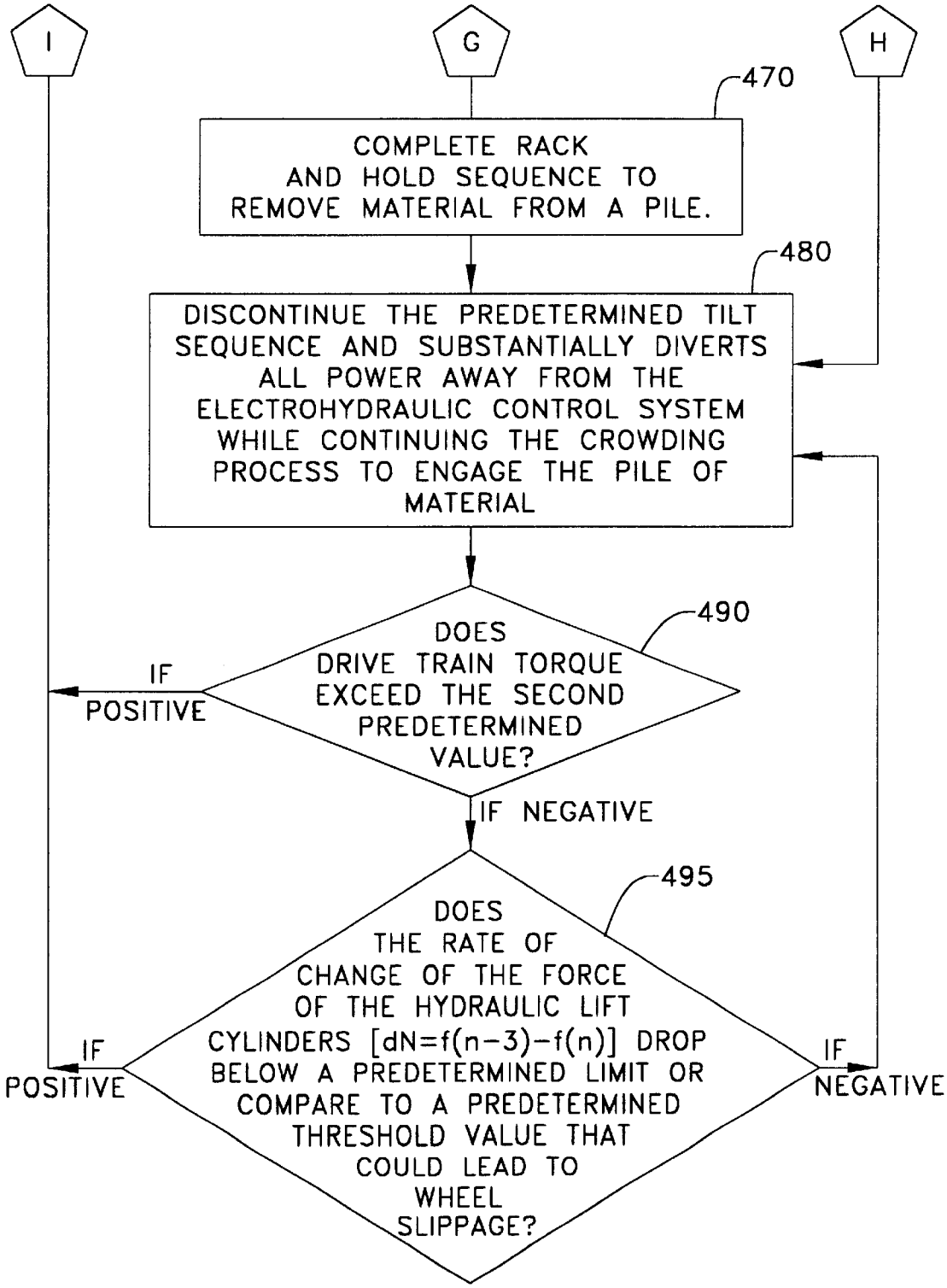

A fifth program step <450> is a determination of whether the drivetrain torque T of the loader 12 falls below a second predetermined value. If the response to this query is negative, then the software program proceeds to a sixth program step <460>, which determines if a rack and hold sequence with the loader 12 has occurred. If the answer to this query is negative, then program steps <440>, <450>, and <460> are repeated. If the answer to the query in programs step <460> is positive, then the rack and hold sequence is completed as the seventh program step <470>, as shown in FIG. 5B. Lift may be included in this sequence, however, lift is typically not an aspect of this sequence.

If the response to the query in the fifth program step <450> involving the determination if the drivetrain torque T of the loader 12 falls below a second predetermined value is positive, then the software program proceeds to the eighth program step <480>, which turns off the predetermined tilt sequence and substantially diverts all power from the electrohydraulic control system 120 of the loader 12 to the drivetrain 28 of the loader 12 to continue the crowding process to engage the pile of material 23.

A ninth program step <490> determines if the drivetrain torque T of the loader 12 exceeds a third predetermined value. This third predetermined value is typically similar, if not identical, to the first predetermined value, however depending the configuration of the loader 12, this third predetermined value may be different than the first predetermined value. If the response to this query is positive, then the software program goes to program step <440> to again utilize the predetermined tilt sequence, and hopefully, unless diverted again into program step <480> will complete the rack and hold sequence with program steps <450> through <470>.

If the response to this query is negative, then the software program proceeds to a tenth program step <495>, which then determines, utilizing force value forecasting, the rate of change $dN=f(n-3)-f(n)$ of force in the hydraulic lift cylinder (s) 20 in order to predict when the lift force will drop below a predetermined limit value that is needed in order to overcome hydraulic lag. This predetermined limit values is dependent on the type, manufacturer, and size of earth moving machine and associated hydraulic system. The rate of change of force in the hydraulic lift cylinder(s) 20 can also be compared to a predetermined threshold value. This predetermined limit values is dependent on the type, manufacturer, and size of earth moving machine and associated hydraulic system. In both instances, this would determine how quickly lift force could reach a level that would lead to slippage of the wheels 13. If the response to this query is positive, then the software program goes to program step <440> to again utilize the predetermined tilt sequence, and hopefully, unless diverted again into program step <480> will complete the rack and hold sequence with program steps <450> through <470>.

If the response to this query in program step <495> is negative, then the software program again goes back to program step <480>, which turns off the predetermined tilt sequence and substantially diverts all power from the electrohydraulic control system 120 of the loader 12 to the drivetrain 28 of the loader 12 to continue the crowding process as well as program step <490> which determines if the drivetrain torque T of the loader 12 exceeds a second predetermined value.

Industrial Applicability

The present invention is an automatic work implement that is applicable to a wide variety of machines such as track-type loaders and other machines having similar material loading implements.

Although operation of the loader 12 by a human operator and automatically can be very similar, there can be some significant differences between a loader 12 operated by human operator based on discrete values of output torque supplied to the wheels of the loader 12 and a wheeled earthmoving machine 12 that is automatically controlled based on discrete values of output torque supplied to the wheels of the earthmoving machine 12, respectively, for loading material where a nonlimiting example of the loader 12 is a wheel loader.

Initially, the loader 12 has substantially all power transferred to the drivetrain 28 in order for the bucket 16 to take a good "bite" out of the pile of material 23 and maximize traction for the wheels 13, as shown in FIG. 1. If this is the initial penetration of the bucket 16 and a predetermined lift cylinder force is exceeded, then substantially all of the power in the loader 12 is diverted to the drivetrain 28 with minimal power applied to hydraulics controlling the work implement 14, with very little power, if any, applied to the lift cylinder control valves 133. This will only occur after this predetermined lift cylinder force is exceeded, which indicates the wheels 13 of the loader 12 have good traction to allow this substantial diversion of power to the drivetrain 28.

The beginning of the discrete torque-based algorithm is where the bucket 16, has achieved initial penetration into the pile of material 23 and the force on the hydraulic lift cylinder(s) 20 has exceeded a predetermined value. This predetermined value is dependent on the manufacturer of the loader 12 and associated configuration as well as the nature of the pile of material 23. At this point, the lift command is set to zero by closing the lift cylinder control valves 133, as shown in FIG. 2, and transmitting all power through the drivetrain 28 of the loader 12. An operator may open the lift cylinder control valves 133 when the force of the lift cylinder 20 is higher than the setting of the primary hydraulic relief valve 138. This would mean that power is wasted by sending flow across the primary hydraulic relief valve 138. Torque continues to build until the first predetermined value or set point A. This predetermined value or set point A indicates the beginning of a second segment.

At this point of full penetration, the loader 12 enters a predetermined tilt command sequence with the electronic controller 128 providing command signals through the implement controller 129 to the tilt cylinder control valves 132 that actuates the hydraulic tilt cylinder 26. This predetermined tilt command sequence is generated to move the tip of the bucket 16 closer to the surface of the material in the pile 23, eventually relieving the drivetrain torque T by reducing the resistance from the pile of material 23, so that the loader 12 can move forward as the material in the bucket 16 moves towards the back of the bucket 16. The human operator may not let the loader 12 apply full crowding capacity on the pile of material 23 if the human operator is constantly utilizing the manual control lever inputs 130 to activate the hydraulic implement controller 129 or if the operator pauses in the use of the hydraulic implement controller 129 through the manual control lever inputs 130, he or she may not pause long enough to allow the bucket 16 to break through a tougher pile of material 23.

Racking of the bucket 16 too quickly or too much can bring the bucket toward the surface of the pile of material 23 before the bucket 16 was full and could reduce the force in the hydraulic lift cylinder(s) 20, leading to slippage of the wheels 13. Therefore, the predetermined tilt command sequence is turned off when the drivetrain torque T falls below a second predetermined value or set point B.

The tilt command then drops to approximately zero and raises again to a maximum value. Optionally, maintaining the predetermined tilt command sequence, even if the drivetrain torque falls below the second predetermined value or set point B so long as the force of the hydraulic lift cylinder(s) 20 exceeds a predetermined percentage of the main relief valve, e.g., 110%, for the electrohydraulic control system 120 for the loader 12.

The tilt command drops again to approximately zero and raises again to the maximum value.

The following description is only for the purposes of illustration and is not intended to limit the present invention as such. It will be recognizable, by those skilled in the art, that the present invention is suitable for a plurality of other applications.

Other aspects, objects and advantages of the present invention can be obtained from a study of the drawings, the disclosure and the appended claims.

What is claimed is:

1. A control system for automatically controlling a work implement of an earthmoving machine having wheels, said work implement including a bucket, to capture, lift and dump material, said bucket being controllably actuated by a hydraulic tilt cylinder and at least one hydraulic lift cylinder, said system comprising:

a torque indicating mechanism that provides a representative value for an amount of torque applied to said wheels of said earthmoving machine;

an electronic controller for receiving said representative torque value from said torque indicating mechanism and determining if said representative value of torque received from said torque indicating mechanism exceeds a first predetermined value and then responsively generating a first command signal; and a hydraulic implement controller for controlling hydraulic fluid flow to said hydraulic tilt cylinder in a predetermined sequence activated in response to said first command signal with said hydraulic tilt cylinder controllably actuating said bucket of the earthmoving machine in order to remove material from a pile.

2. The control system, as defined in claim 1, wherein said predetermined sequence includes a rack and hold sequence in order to remove material with said bucket.

3. A control system for automatically controlling a work implement of an earthmoving machine having a drivetrain and wheels, said work implement including a bucket, to capture, lift and dump material, said bucket being controllably actuated by a hydraulic tilt cylinder and at least one hydraulic lift cylinder, said system comprising:

a torque indicating mechanism that provides a representative value for an amount of torque applied to said wheels of said earthmoving machine;

a force indicating mechanism that generates a representative value for an amount of force applied to said at least one hydraulic lift cylinder; and an electronic controller for receiving said representative torque value from said torque indicating mechanism and said representative force value from said force indicating mechanism and then determining if said representative value of torque received from said torque indicating mechanism is below a first predetermined value and then determining if said representative value of force applied to said lift cylinder exceeds a predetermined value and then directing substantially all power of said earthmoving machine to said drivetrain of said earthmoving machine.

4. The control system, as defined in claim 3, wherein said bucket of said earthmoving machine performs a crowding process on said material.

5. The control system, as defined in claim 1, wherein said electronic controller determines if said representative value of torque received from said torque indicating mechanism is less than a second predetermined value and then responsively generating a second command signal so that said hydraulic implement controller discontinues said predetermined sequence of controlling hydraulic fluid flow to said hydraulic tilt cylinder in response to said second command signal.

6. The control system, as defined in claim 5, wherein substantially all power of said earthmoving machine will be directed to said drivetrain of said earthmoving machine so that said bucket of said earthmoving machine performs a crowding process in order to engage said material.

7. The control system, as defined in claim 6, wherein said electronic controller determines if said representative value of torque received from said torque indicating mechanism exceeds a third predetermined value and then responsively generates a third command signal so that said hydraulic implement controller controls hydraulic fluid flow to said hydraulic tilt cylinder in a predetermined sequence activated in response to said third command signal controllably actuating said bucket of the earthmoving machine in order to remove material from a pile.

8. The control system, as defined in claim 7, wherein said electronic controller determines if said value of representative torque received from said torque indicating mechanism does not exceed said third predetermined value then directing substantially all power of said earthmoving machine to said drivetrain of said earthmoving machine so that said bucket of said earthmoving machine performs a crowding process in order to engage said material.

9. The control system, as defined in claim 7, wherein said electronic controller determines if said representative value of torque received from said torque indicating mechanism does not exceed said third predetermined value and said electronic controller determines if a representative force value of said at least one hydraulic lift cylinder, received from a force indicating mechanism, does not exceed a predetermined percentage of force for a primary hydraulic relief valve then directing substantially all power for said earthmoving machine to said drivetrain of said earthmoving machine so that said bucket of said earthmoving machine performs a crowding process in order to engage said material.

10. The control system, as defined in claim 7, wherein said electronic controller determines if said representative value received from said torque indicating mechanism does not exceed said third predetermined value and said electronic controller determines if a representative force value of said at least one hydraulic lift cylinder, received from a force indicating mechanism, exceeds a predetermined percentage of force for a primary hydraulic relief valve then said hydraulic implement controller will control hydraulic fluid flow to said hydraulic tilt cylinder in a predetermined sequence controllably actuating said bucket of the earthmoving machine in order to remove material from a pile.

11. The control system, as defined in claim 7, wherein said electronic controller determines if said representative value of torque received from said torque indicating mechanism does not exceed said third predetermined value and said electronic controller determines if a rate of change in force of said at least one hydraulic lift cylinder does not drop below a predetermined limit value then directing substantially all power of said earthmoving machine to said drivetrain of said earthmoving machine so that said bucket of said earthmoving machine performs a crowding process in order to engage said material.

12. The control system, as defined in claim 7, wherein said electronic controller determines if said representative value of torque received from said torque indicating mechanism does not exceed said third predetermined value and said electronic controller determines if a rate of change in force of said at least one hydraulic lift cylinder exceeds a predetermined limit value then said hydraulic implement controller will control hydraulic fluid flow to said hydraulic tilt cylinder in a predetermined sequence controllably actuating said bucket of the earthmoving machine in order to remove material from a pile.

13. The control system, as defined in claim 12, wherein said predetermined limit value is determined by the equation $dN=[f(n-3)-f(n)]$.

14. The control system, as defined in claim 7, wherein said electronic controller determines if said representative value of torque received from said torque indicating mechanism does not exceed said third predetermined value and said electronic controller determines if a rate of change in force of said at least one hydraulic lift cylinder does not drop below a predetermined threshold value then directing substantially all power of said earthmoving machine to said drivetrain of said earthmoving machine so that said bucket of said earthmoving machine performs a crowding process in order to engage said material.

15. The control system, as defined in claim 7, wherein said electronic controller determines if said representative value of torque received from said torque indicating mechanism does not exceed said second predetermined value and said electronic controller determines if a rate of change in force of said at least one hydraulic lift cylinder exceeds a predetermined threshold value then said hydraulic implement controller will control hydraulic fluid flow to said hydraulic tilt cylinder in a predetermined sequence controllably actuating said bucket of the earthmoving machine in order to remove material from a pile.

16. A method for controlling a work implement of an earthmoving machine having wheels, said work implement including a bucket, to capture, lift and dump material, said bucket being controllably actuated by a hydraulic tilt cylinder and at least one hydraulic lift cylinder, said method comprising the steps of:

providing a representative value of torque applied to said wheels of said earthmoving machine with a torque indicating mechanism;

receiving said representative torque signal from said torque indicating mechanism and determining if said representative value of torque received from said torque indicating mechanism exceeds a first predetermined value and then responsively generating a first command signal with an electronic controller; and controlling hydraulic fluid flow to said hydraulic tilt cylinder in a predetermined sequence activated in response to said first command signal with said hydraulic tilt cylinder, with a hydraulic implement controller, thereby controllably actuating said bucket of the earthmoving machine in order to remove material from a pile.

17. A method for automatically controlling a work implement of an earthmoving machine having a drivetrain and wheels, said work implement including a bucket, to capture, lift and dump material, said bucket being controllably actuated by a hydraulic tilt cylinder and at least one hydraulic lift cylinder, said method comprising the steps of:

providing a representative value of torque applied to said wheels of said earthmoving machine with a torque indicating mechanism; and receiving said representative torque signal from said torque indicating mechanism and then determining if said representative value of torque received from said torque indicating mechanism is below a first predetermined value and then determining if a representative value of force applied to said lift cylinder exceeds a predetermined value, with an electronic controller, then directing substantially all power of said earthmoving machine to said drivetrain of said earthmoving machine.

18. The method, as defined in claim 16, further including the step of:

determining if said representative value of torque received from said torque indicating mechanism is less than a second predetermined value and then responsively generating a second command signal, with said electronic controller, so that said hydraulic implement controller discontinues said predetermined sequence of controlling hydraulic fluid flow to said hydraulic tilt cylinder in response to said second command signal.

19. The method, as defined in claim 18, further including the step of:

directing substantially all power to said drivetrain of said earthmoving machine so that said bucket of said earthmoving machine performs a crowding process in order to engage said material.

20. The method, as defined in claim 19, further including the step of:

determining if said representative value of torque received from said torque indicating mechanism exceeds a third predetermined value and then responsively generates a third command signal, with said electronic controller, so that said hydraulic implement controller controls hydraulic fluid flow to said hydraulic tilt cylinder in a predetermined sequence activated in response to said third command signal; and controllably actuating said bucket of the earthmoving machine in order to remove material from a pile.

21. The method, as defined in claim 20, further including the step of:

determining if said representative value of torque received from said torque indicating mechanism exceeds a third predetermined value and then responsively generates a third command signal, with said electronic controller, so that said hydraulic implement controller controls hydraulic fluid flow to said hydraulic tilt cylinder in a predetermined sequence activated in response to said third command signal; and controllably actuating said bucket of the earthmoving machine in order to remove material from a pile.

22. The method, as defined in claim 20, further including the step of:

determining if said representative value of torque received from said torque indicating mechanism does not exceed said third predetermined value and determining if a rate in change in force of said at least one hydraulic lift cylinder exceeds a predetermined limit value, with said electronic controller, then said hydraulic implement controller will control hydraulic fluid flow to said hydraulic tilt cylinder in a predetermined sequence; and controllably actuating said bucket of the earthmoving machine in order to remove material from a pile.

23. The method, as defined in claim 20, further including the step of:

determining if said value of torque received from said torque indicating mechanism does not exceed said second predetermined value and said electronic controller determines if a rate in change in force of said at least one hydraulic lift cylinder exceeds a predetermined threshold value, by said electronic controller, then said hydraulic implement controller will control hydraulic fluid flow to said hydraulic tilt cylinder in a predetermined sequence controllably actuating said bucket of the earthmoving machine in order to remove material from a pile.

* * * * *